US008197773B2

(12) United States Patent
Fukuoka et al.

(10) Patent No.: US 8,197,773 B2
(45) Date of Patent: Jun. 12, 2012

(54) MICRO FLUID DEVICE

(75) Inventors: Masateru Fukuoka, Osaka (JP); Kazuki Yamamoto, Kyoto (JP); Yoshinori Akagi, Osaka (JP); Hiroji Fukui, Kouka (JP)

(73) Assignee: Sekisui Chemical Co., Ltd., Osaka (JP)

( * ) Notice: Subject to any disclaimer, the term of this patent is extended or adjusted under 35 U.S.C. 154(b) by 101 days.

(21) Appl. No.: 12/921,247

(22) PCT Filed: Mar. 11, 2009

(86) PCT No.: PCT/JP2009/054623

§ 371 (c)(1),
(2), (4) Date: Sep. 7, 2010

(87) PCT Pub. No.: WO2009/113567

PCT Pub. Date: Sep. 17, 2009

(65) Prior Publication Data

US 2011/0044863 A1 Feb. 24, 2011

(30) Foreign Application Priority Data

| | | |
|---|---|---|
| Mar. 11, 2008 | (JP) | 2008-061290 |
| Mar. 24, 2008 | (JP) | 2008-076178 |
| Jun. 17, 2008 | (JP) | 2008-157448 |
| Jul. 18, 2008 | (JP) | 2008-187492 |
| Sep. 1, 2008 | (JP) | 2008-223331 |
| Sep. 10, 2008 | (JP) | 2008-231970 |

(51) Int. Cl.
*B01L 3/00* (2006.01)

(52) U.S. Cl. ..... 422/504; 422/129; 422/502; 137/803; 435/288.5

(58) Field of Classification Search ..... None
See application file for complete search history.

(56) References Cited

U.S. PATENT DOCUMENTS

| | | | | |
|---|---|---|---|---|
| 7,118,910 | B2 * | 10/2006 | Unger et al. | 435/288.5 |
| 7,749,444 | B2 * | 7/2010 | Yamada et al. | 422/81 |
| 8,075,855 | B2 * | 12/2011 | McAvoy et al. | 422/504 |

(Continued)

FOREIGN PATENT DOCUMENTS

EP 1 992 402 A1 11/2008

(Continued)

OTHER PUBLICATIONS

International Preliminary Report on Patentability for Application No. PCT/JP2009/054623 mailed Nov. 11, 2010.

(Continued)

*Primary Examiner* — In Suk Bullock
*Assistant Examiner* — Timothy G Kingan
(74) *Attorney, Agent, or Firm* — Cheng Law Group, PLLC

(57) ABSTRACT

The present invention provides a microfluidic device with a micro-pump system in which the production process is simplified and the device is further downsized. A microfluidic device 1 has a gas generation portion 3. The gas generation portion 3 has a substrate 10 and a gas generation layer 20. The substrate 10 has a first main surface 10*a* and a second main surface 10*b*. The substrate 10 has a micro-channel 14 with an opening at least on the first main surface 10*a*. The gas generation layer 20 is disposed on the first main surface 10*a* of the substrate 10 so as to cover an opening 14*a*. The gas generation layer 20 generates gas by receiving an external stimulus.

17 Claims, 8 Drawing Sheets

U.S. PATENT DOCUMENTS

| | | | | |
|---|---|---|---|---|
| 2009/0126516 | A1 * | 5/2009 | Yamamoto et al. | 73/864.22 |
| 2009/0314366 | A1 * | 12/2009 | Weng et al. | 137/814 |

FOREIGN PATENT DOCUMENTS

| | | | |
|---|---|---|---|
| JP | 2005-32537 | A | 2/2005 |
| JP | 2005-297102 | A | 10/2005 |
| JP | 2005-300425 | A | 10/2005 |
| JP | 2007-279069 | A | 10/2007 |
| WO | WO 2007/105584 | * | 9/2007 |

OTHER PUBLICATIONS

International Search Report for the Application No. PCT/JP2009/054823 mailed May 19, 2009.

* cited by examiner

MICRO FLUID DEVICE

TECHNICAL FIELD

The present invention relates to a microfluidic device. More specifically, the present invention relates to a microfluidic device with a micro pump system.

BACKGROUND ART

Patent Document 1, for example, discloses a micro total analysis system with a micro-pump system therein as an example of a microfluidic device. The micro-pump system of Patent Document 1 has a substrate in which a fine passage and a micro-pump chamber filled with a gas generating material are formed. The micro-pump system of Patent Document 1 irradiates the micro-pump chamber with light or applies heat so that the gas generating material generates gas to activate the micro-pump system. Accordingly, the micro-pump system of Patent Document 1 does not require a complicated mechanical structure. Employing the structure disclosed in Patent Document 1 therefore makes it possible to downsize the micro-pump system and simplify the production of the micro-pump system.

Patent Document 1: JP 2005-297102 A

DISCLOSURE OF THE INVENTION

The micro-pump system disclosed in Patent Document 1, however, requires the micro-pump chamber to be formed in the substrate. This tends to complicate the production process of the micro-pump system. Further, sufficiently satisfying the desire of downsizing the micro-pump system further is difficult.

The present invention was made in view of the above issues and aims to simplify the production process of the microfluidic device with the micro-pump system and to further downsize the microfluidic device.

The microfluidic device according to the present invention has a gas generation portion. The gas generation portion has a substrate and a gas generation layer. The substrate has a first main surface and a second main surface. The substrate has a micro-channel open to the first main surface. The gas generation layer is disposed on the first main surface of the substrate so as to cover the opening. The gas generation layer generates gas by receiving an external stimulus.

In a particular aspect of the present invention, the gas generation layer is a gas generation film attached on the first main surface.

In another particular aspect of the present invention, the gas generation portion further has a barrier layer provided on the reverse side of the substrate side of the gas generation layer.

In another particular aspect of the present invention, the barrier layer is disposed so as to cover the gas generation layer and is joined to the substrate over the entire outer periphery of the gas generation layer.

In yet another particular aspect of the present invention, the gas generation layer has a continuous hole that is connected to the opening at one end thereof and is connected, at another end thereof, to a surface on the reverse side of the substrate side of the gas generation layer.

In yet another aspect of the present invention, the barrier layer is a membrane or a plate made of glass or resin.

In yet another aspect of the present invention, the substrate has a plurality of the micro-channels, and the gas generation layer includes a gas generator generating gas upon being irradiated with light and further has a light shield layer that is provided, in a plane view, between the adjacent openings of the micro-channels so as to shield the gas generation layer from light.

In yet another particular aspect of the present invention, the gas generation layer is attached on the substrate, and the microfluidic device has a groove or hole which is connected to the opening, on at least one of the substrate-side surface of the gas generation layer and the first main surface of the substrate.

The groove or the hole preferably extends from the opening toward the surface of the substrate.

The microfluidic device preferably has a plurality of the grooves or the holes, and the plurality of the grooves or the holes each preferably extend radially from the opening toward the surface of the substrate.

In yet another particular aspect of the present invention, at least one of the substrate-side surface of the gas generation layer and the first main surface of the substrate is a rough surface.

The gas generation layer preferably contains a gas generator that generates gas by receiving an external stimulus.

The gas generator preferably contains at least one of an azo compound and an azide compound.

The gas generation layer preferably further contains a binder resin.

In yet another particular aspect of the present invention, the micro-channel has a plurality of openings on the first main surface.

In yet another particular aspect of the present invention, the substrate preferably has a plurality of the micro-channels that are connected to one another.

EFFECT OF THE INVENTION

In the present invention, the gas generation layer provided on the substrate supplies gas to the micro-channel. This makes it possible to simplify the production process of the microfluidic device with the micro-pump system and to further downsize the microfluidic device.

EXPLANATION OF SYMBOLS

Figure 1:
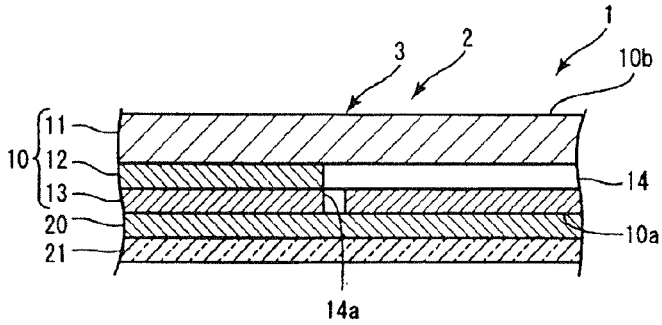
FIG. 1 is a cross-sectional view of a microfluidic device according to a first embodiment.

1 Microfluidic device
2 Micro-pump system
3 Gas generation portion
10 Substrate
10*a* First main surface
10*b* Second main surface
10*c* Groove
11 First substrate
12 Second substrate
13 Third substrate
14 Micro-channel
14*a* Opening
14*b* Main channel
14*c* Sub channel
20 Gas generation layer
20*a* Continuous hole
20*b* Groove
21 Barrier layer
21*a* Peripheral portion
22 Light shield layer
23 Light
30 Gas outlet
31 Micro-channel group
32 Micro-channel set
33, 34 Pressure-sensitive adhesive layer
35 Through hole

BEST MODE FOR CARRYING OUT THE INVENTION

First Embodiment

Hereinafter, an example of a preferable embodiment of the present invention will be described based on an example of microfluidic device 1 illustrated in FIG. 1. Note that the microfluidic device 1 is just an example and the present invention is not limited to the microfluidic device 1.

FIG. 1 is a cross-sectional view of the microfluidic device 1. The microfluidic device 1 is not particularly limited as long as it is a device having a micro-channel. The microfluidic device 1 may be, for example, a microanalyzer for heavy metal analysis or biochemical analysis. If the microfluidic device 1 is a microanalyzer, the microfluidic device 1 may further have a detecting portion or an analyzing portion which is formed in a substrate 10 in a manner connecting to a micro-channel 14.

Note that the "micro-channel" herein refers to a channel formed into shapes and dimensions that allow liquid flowing through the micro-channel to receive a strong influence of surface tension and a capillary phenomenon, and thus to behave differently from liquid flowing through a channel with general dimensions. That is, the "micro-channel" refers to a channel formed into shapes and dimensions that express a so-called micro effect on the liquid flowing through the micro-channel.

The shapes and dimensions of the channel leading to expression of the micro effect differ according to physical properties of the liquid introduced into the channel. For example, if the micro-channel has a rectangular cross-sectional shape, the smaller of the height and width of the cross section of the micro-channel is generally set to 5 mm or smaller, preferably 500 μm or smaller, and more preferably 200 μm or smaller. If the micro-channel has a circular cross-sectional shape, the diameter of the micro-channel is generally set to 5 mm or smaller, preferably 500 μm or smaller, and more preferably 200 μm or smaller.

The microfluidic device 1 has a micro-pump system 2 as illustrated in FIG. 1. The micro-pump system 2 has a gas generation portion 3 formed therein. The gas generation portion 3 has a substrate 10, a gas generation layer 20, and a barrier layer 21.

The substrate 10 has a first main surface 10*a* and a second main surface 10*b*. Note that the first main surface 10*a* does not include the inner periphery of an opening 14*a*. That is, the main surface, when a depressed portion is formed thereon, does not include the surface of the depressed portion.

The substrate 10 has the micro-channel 14 formed therein. The micro-channel 14 is open to the first main surface 10*a* of the substrate 10. In other words, the micro-channel 14 has the opening 14*a* on the first main surface 10*a*. In the present embodiment, an example is described in which the micro-channel 14 is open only to the first main surface 10*a*. The micro-channel 14, however, may be open to both the first main surface 10*a* and the second main surface 10*b*.

The material of the substrate 10 is not particularly limited. The substrate 10 may be, for example, made of glass or resin. More specifically, the substrate 10 may be made of, for example, an organic siloxane compound. Specific examples of the organic siloxane compound include poly(dimethylsiloxane) (PDMS) and polymethylhydrosiloxane.

If the substrate 10 is to be produced by curing a resin after the resin is poured into a mold, it is particularly preferable that the substrate 10 be substantially made of PDMS. A member made of PDMS has high transcription, which means that use of PDMS makes it possible to produce a substrate 10 that has high form accuracy. Further, PDMS has excellent light transmittance and thus leads to production of a substrate 10 that has high light transmittance.

The substrate 10 of the present embodiment has a first substrate 11, a second substrate 12, and a third substrate 13. Here, the substrate 10 may have one substrate or may have two or more substrates.

The first main surface 10*a* of the substrate 10 is preferably anchored. Anchoring the first main surface 10*a* of the substrate 10 can prevent generation of gas between the substrate 10 and the gas generation layer 20 and prevent the generating gas from accumulating between the substrate 10 and the gas generation layer 20.

Examples of the anchoring include performing a corona discharge treatment and applying a surface treatment agent, on the first main surface 10*a* of the substrate 10. Here, examples of the surface treatment agent include urethane resins; (meth)acrylate copolymers; polymers or copolymers containing a 1,3-conjugated diene monomer; polymerized oligomers or copolymerized oligomers containing a 1,3-conjugated diene monomer; polymers or copolymers containing a 1,3-conjugated diene monomer derivative; oligomers or copolymerized oligomers containing a 1,3-conjugated diene monomer derivative; and a mixture of these.

The substrate 10 has the gas generation layer 20 disposed on the first main surface 10*a*. The gas generation layer 20 of the present embodiment is attached on the substrate 10. This gas generation layer 20 covers the opening 14*a*.

The gas generation layer 20 has a thickness of preferably 1 μm to 200 μm, more preferably 5 μm to 100 μm, and still more preferably 10 μm to 50 μm. A thickness of the gas generation layer 20 of 1 μm or smaller may lead to a small amount of gas generating upon receipt of an external stimulus, or may lead to insufficient adhesion to the substrate 10 when the binder resin contains a pressure-sensitive adhesive resin. On the other hand, a thickness of the gas generation layer 20 of 200 μm or larger tends to require a long time for the generating gas to reach the substrate 10.

The gas generation layer 20 is a layer that generates gas by receiving an external stimulus. The gas generation layer 20 contains at least a gas generator that generates gas by receiving an external stimulus. The gas generation layer 20 of the present embodiment contains a gas generator and a binder. The gas generation layer 20 may further contain various additives.

The external stimulus in the present invention means a physical or chemical stimulus that is supplied from the exterior so that a gas generation reaction is caused in the gas generation portion. That is, an external stimulus functions to cause the gas generation portion to generate gas. Specific examples of the external stimulus include energies such as light and heat, and materials such as an acid and a base. That is, "receiving an external stimulus" include being irradiated with an energy such as light or heat, and being supplied with a material such as an acid or a base.

The external stimulus is not particularly limited as long as it causes the gas generation portion to have a gas generation reaction, and light is preferable as the external stimulus. Irradiation of light can be easily turned on or off and light intensity can be easily adjusted. Hence, if light serves as the external stimulus, gas generation can be easily controlled and high responsiveness of gas generation can be easily achieved. Further, if light serves as the external stimulus, heat durability required for the substrate 10 decreases, and therefore the substrate 10 can be chosen more freely.

The gas generator may contain only a material that generates gas by receiving an external stimulus. Alternatively, the gas generator may contain a stimulus generator which, upon receipt of an external stimulus, generates another stimulus, and a stimulus gas generator generating gas by receiving the stimulus generated by the stimulus generator.

The gas generator may contain a material generating an acid or an alkali by receiving light or heat, and a material generating gas by receiving the acid or the alkali generated by the above material. More specifically, the gas generating material may contain a photoacid generator generating an acid upon irradiation with light, and an acid stimulation gas generator generating gas upon contact with an acid. The gas generating material may alternatively contain a photobase generator generating a base upon irradiation with light, and a base multiplying agent generating basic gas upon contact with a base.

The light to irradiate the gas generation layer 20 is not particularly limited as long as the light has a wavelength within a range that the gas generator or a sensitizer absorbs. The light is preferably an ultraviolet light having a wavelength of 10 nm to 400 nm or a blue light having a wavelength of 400 nm to 420 nm which is near the ultraviolet light. The light is more preferably a near ultraviolet light having a wavelength of 300 nm to 400 nm.

The light source to irradiate the gas generation layer 20 is not particularly limited. Specific examples of the light source include low pressure mercury lamps, medium pressure mercury lamps, high pressure mercury lamps, ultra-high pressure mercury lamps, light emitting diodes (LED), all solid state lasers, chemical lamps, black light lamps, microwave excitation mercury lamps, metal halide lamps, sodium lamps, halogen lamps, xenon lamps, and fluorescent lamps. Among these, light emitting elements such as light emitting diodes (LED), which do not produce much heat and are inexpensive, are preferable as a light source.

Specific examples of the gas generator include azo compounds and azide compounds. The azo compound may be an azoamide compound.

Specific examples of the azo compound include 2,2'-azobis(N-cyclohexyl-2-methylpropionamide), 2,2'-azobis[N-(2-methylpropyl)-2-methylpropionamide], 2,2'-azobis(N-butyl-2-methylpropionamide), 2,2'-azobis[N-(2-methylethyl)-2-methylpropionamide], 2,2'-azobis(N-hexyl-2-methylpropionamide), 2,2'-azobis(N-propyl-2-methylpropionamide), 2,2'-azobis(N-ethyl-2-methylpropionamide), 2,2'-azobis{2-methyl-N-[1,1-bis(hydroxymethyl)-2-hydroxyethyl]propionamide}, 2,2'-azobis{2-methyl-N-[2-(1-hydroxybutyl)]propionamide}, 2,2'-azobis[2-methyl-N-(2-hydroxyethyl)propionamide], 2,2'-azobis[N-(2-propenyl)-2-methylpropionamide], 2,2'-azobis[2-(5-methyl-2-imidazoline-2-yl)propane]dihydrochloride, 2,2'-azobis[2-(2-imidazoline-2-yl)propane]dihydrochloride, 2,2'-azobis[2-(2-imidazoline-2-yl)propane]disulfate dihydrate, 2,2'-azobis[2-(3,4,5,6-tetrahydropyrimidine-2-yl)propane]dihydrochloride, 2,2'-azobis{2-[1-(2-hydroxyethyl)-2-imidazoline-2-yl]propane}dihydrochloride, 2,2'-azobis[2-(2-imidazoline-2-yl)propane], 2,2'-azobis(2-methylpropionamidine)hydrochloride, 2,2'-azobis(2-aminopropane)dihydrochloride, 2,2'-azobis[N-(2-carboxyacyl)-2-methylpropionamidine], 2,2'-azobis{2-[N-(2-carboxyethyl)amidine]propane}, 2,2'-azobis(2-methylpropionamideoxime), dimethyl-2,2'-azobis(2-methylpropionate), dimethyl-2,2'-azobisisobutyrate, 4,4'-azobis(4-cyan carbonic acid), 4,4'-azobis(4-cyanopentanoic acid), and 2,2'-azobis(2,4,4-trimethylpentane). These azo compounds generate nitrogen gas by receiving a stimulus such as heat or a light having a wavelength in a certain range.

Specific examples of the azide compound include 3-azidomethyl-3-methyloxetane, terephthalazide, and polymers containing an azido group. Specific examples of the polymer containing an azido group include glycidyl azide polymers. A glycidyl azide polymer can be produced by, for example, ring-opening polymerization of p-tert-butyl benzazide and 3-azidomethyl-3-methyloxetane. These azide compounds are degraded upon receiving a stimulus such as a light having a wavelength in a certain range, heat, ultrasonic waves, or impacts, and thereby generate nitrogen gas.

Azo compounds do not generate gas by shocks, and therefore can be handled very easily. Further, azo compounds do not cause a chain reaction to explosively generate gas, and pausing the light irradiation allows cease of gas generation from the compounds. Accordingly, use of an azo compound as a gas generator facilitates control of the gas generation amount.

The gas generator such as an azo compound preferably has high heat resistance. More specifically, the 10-hour half-life temperature of the gas generator is preferably 80° C. or higher. Providing high heat resistance to the gas generator allows the microfluidic device 1 to be suitably used even at a high temperature. Further, providing high heat resistance to the gas generator also prevents deterioration of the microfluidic device 1 during storage.

Examples of the azo compound having 80° C. or higher of the 10-hour half-life temperature include an azoamide compound represented by the following general formula (3). An azoamide compound represented by the following general formula (3) has excellent solubility in a polymer having pressure-sensitive adhesion such as an alkyl acrylate polymer, as well as excellent heat resistance. This makes it possible to prevent the azoamide compound from changing into particles in the pressure-sensitive adhesive resin.

[Chem. 1]

(3)

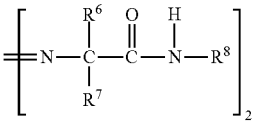

$R^6$ and $R^7$ in the general formula (3) separately represent a lower alkyl group, and $R^8$ represents a $C_2$ or higher saturated alkyl group. Note that $R^6$ and $R^7$ may be the same or different.

Specific examples of the azoamide compound represented by the above general formula (3) include 2,2'-azobis(N-cyclohexyl-2-methylpropionamide), 2,2'-azobis[N-(2-methylpropyl)-2-methylpropionamide], 2,2'-azobis(N-butyl-2-methylpropionamide), 2,2'-azobis[N-(2-methylethyl)-2-methylpropionamide], 2,2'-azobis(N-hexyl-2-methylpropionamide), 2,2'-azobis(N-propyl-2-methylpropionamide), 2,2'-azobis(N-ethyl-2-methylpropionamide), 2,2'-azobis{2-methyl-N-[1,1-bis(hydroxymethyl)-2-hydroxyethyl]propionamide}, 2,2'-azobis{2-methyl-N-[2-(1-hydroxybutyl)]propionamide}, 2,2'-azobis[2-methyl-N-(2-hydroxyethyl)propionamide], and 2,2'-azobis[N-(2-propenyl)-2-methylpropionamide].

Among these, 2,2'-azobis(N-butyl-2-methylpropionamide) and 2,2'-azobis[N-(2-propenyl)-2-methylpropionamide] have particularly excellent solubility in a solvent, and are thus suitably used.

The photoacid generator is not particularly limited. For example, a known photoacid generator can be used as the photoacid generator.

The photoacid generator is preferably at least one compound selected from the group consisting of quinone diazide compounds, onium salts, sulfonates, and organic halides, and is more preferably at least one compound selected from the group consisting of sulfonic acid onium salts, benzylsulfonate, halogenated isocyanurate, and bis(arylsulfonyl)diazomethane. These photoacid generators are efficiently degraded upon irradiation with light, and generate a strong acid such as a sulfonic acid. Hence, use of these photoacid generators makes it possible to further increase the gas generation efficiency.

Examples of the quinone diazide compound include an ester of a low-molecular aromatic hydroquinone compound and one of 1,2-naphthoquinone-2-diazide-5-sulfonic acid and 1,2-naphthoquinone-2-diazide-4-sulfonic acid. Examples of the low-molecular aromatic hydroquinone compound include 1,3,5-trihydroxybenzene, 2,3,4-trihydroxybenzophenone, 2,3,4,4'-tetrahydroxybenzophenone, and cresol. Among these, 1,2-naphthoquinone-2-diazide-5-sulfonic acid p-cresol ester is particularly preferable.

Examples of the onium salt include triphenylsulfonium hexafluoroantimonate and triphenylsulfonium hexafluorophosphate.

Examples of the sulfonates include bis(arylsulfonyl)diazomethane, p-nitrobenzyl-9,10-dimethoxyanthracene-2-sulfonate, m-nitrobenzyl-9,10-dimethoxyanthracene-2-sulfonate, m,p-dinitrobenzyl-9,10-dimethoxyanthracene-2-sulfonate, p-cyanobenzyl-9,10-dimethoxyanthracene-2-sulfonate, chlorobenzyl-9,10-dimethoxyanthracene-2-sulfonate, dimethylaminonaphthalene-5-sulfonate, diphenyliodonium-9,10-dimethoxyanthracene-2-sulfonate, 4-methoxyphenyl-phenyliodonium-9,10-dimethoxyanthracene-2-sulfonate, bis(4-methoxyphenyl)iodonium-9,10-dimethoxyanthracene-2-sulfonate, bis(4-buthylphenyl)iodonium-9,10-dimethoxyanthracene-2-sulfonate, diphenyliodonium-anthracene-2-sulfonate, diphenyliodonium trifluoromethanesulfonate, and (5-propylsulfonyloxyimino-5H-thiophene-2-ylidene)-(2-methylphenyl)acetonitrile. Among these, diphenyliodonium-9,10-dimethoxyanthracene-2-sulfonate, and (5-propylsulfonyloxyimino-5H-thiophene-2-ylidene)-(2-methylphenyl)acetonitrile are particularly preferable which have high acid generation efficiency upon irradiation with light.

Examples of the organic halide include tribromomethylphenylsulfone and tribromomethylsulfonylpyridine.

The acid stimulation gas generator is not particularly limited as long as it generates gas due to acid stimulation, i.e., the action of an acid. At least one of a carbonate and a bicarbonate is preferably used.

Specific examples of the acid stimulation gas generator include sodium bicarbonate, sodium carbonate, sodium sesquicarbonate, magnesium carbonate, potassium carbonate, potassium bicarbonate, calcium carbonate, and sodium borohydride. Each of these acid stimulation gas generators may be used alone, or two or more of these may be used in combination. Among these, sodium bicarbonate and sodium carbonate are preferable as an acid stimulation gas generator, and a mixture of sodium carbonate and sodium bicarbonate is more preferable as an acid stimulation gas generator because the mixture has high stability and generates a large amount of gas.

The blending amount of the acid stimulation gas generator is preferably stoichiometric to the amount of an acid to be generated from the photoacid generator.

Further, each of the acid stimulation gas generator and the photoacid generator may be in a liquid state or a particle state. From the view of increasing handleability and gas generation efficiency, at least one of the acid stimulation gas generator and the photoacid generator is in a fine particle state. Further, at least one of the acid stimulation gas generator and the photoacid generator being in a fine particle state leads to formation of gaps between the fine particles, which allows the generating gas to flow easily. Note that the fine particles herein are particles with an average diameter of 50 μm to 2 mm.

The gas generator is degraded upon irradiation with light, and may contain a photobase generator (A) generating a gaseous base, and a base multiplying agent (B).

The photobase generator (A) may be at least one compound selected from the group consisting of cobalt amine complexes; o-nitrobenzyl carbamate; oxime esters; compounds containing a carbamoyloxyimino group, which generate an amine upon irradiation with light and are represented by the following formula (4); and salts of a carboxylic acid (a1) and a basic compound (a2), which is represented by the following formula (5).

[Chem. 2]

formula (4)

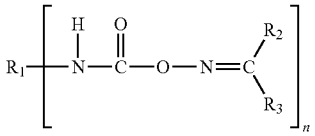

$R_1$ in the formula (4) is an n-valent organic group. $R_2$ and $R_3$ each are hydrogen, an aromatic group, or an aliphatic group. "n" is an integer of 1 or greater.

[Chem. 3]

formula (5)

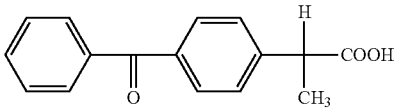

The compound containing a carbamoyloxyimino group, represented by the above formula (4), is not particularly limited. An example of the above compound is a compound produced in the below-described way that JP 2002-138076 A discloses.

An amount of 0.05 mol of hexamethylene diisocyanate was added with 0.1 mol of acetophenone oxime dissolved in 100 ml of tetrahydrofuran (THF). The mixture was stirred for four hours at 50° C. under dry nitrogen atmosphere and a reaction was caused. Then, vaporizing tetrahydrofuran from the reaction mixture led to production of a white solid. The produced white solid was dissolved in methylethylketone of 80° C., and the solution was recrystallized so that a refined compound generating an amine upon irradiation with light was produced.

The above salt of a carboxylic acid (a1) and a basic compound (a2) can be prepared easily by mixing the carboxylic acid (a1) and the basic compound (a2) in a solvent. Mixing the carboxylic acid (a1) and the basic compound (a2) in a vessel causes an acid-base reaction represented by the following reaction formula (S1) to proceed to generate a salt A1.

[Chem. 4]

formula (S1)

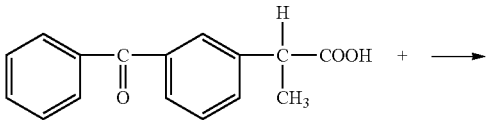

-continued

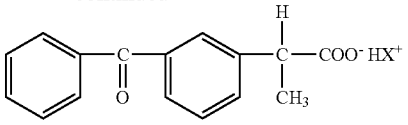

(A1)

X in the above formula (S1) is a basic compound (a2), and (A1) is a salt.

A salt produced in the above way has a framework derived from a carboxylic acid (a1), and thereby easily causes decarboxylation upon irradiation with light and causes the reaction represented by the following reaction formula (S2) to proceed. Accordingly, the above salt alone expresses excellent photodegradability. That is, degradation of the salt rapidly generates basic gas and carbon dioxide and, the generation amounts of the basic gas and carbon dioxide are to be sufficient enough.

[Chem. 5]

formula (S2)

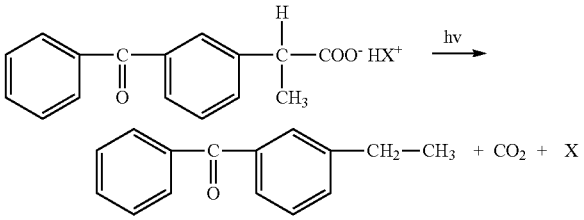

X in the above formula (S2) represents a basic compound (a2).

Examples of the above basic compound (a2) include, but are not particularly limited to, amines such as primary amines, secondary amines, and tertiary amines; compounds containing a pyridyl group; hydrazine compounds; amide compounds; quaternary ammonium hydroxide; mercapto compounds; sulfide compounds; and phosphine compounds. Each of these may be used in combination.

At least one compound selected from the group consisting of the compounds represented by the following formulas (6) to (9) can be suitably used as the basic compound (a2). Use of these compounds allows the above salt to be degraded more rapidly and thus leads to more rapid generation of basic gas and carbon dioxide.

[Chem. 6]

formula (6)

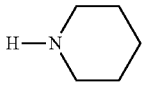

[Chem. 7]

formula (7)

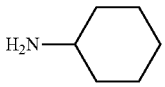

[Chem. 8]

formula (8)

$(CH_3)_4N^+OH^-$

-continued

[Chem. 9]

formula (9)

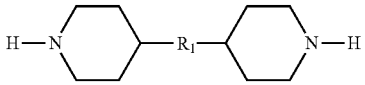

$R_1$ in the above formula (9) represents a $C_1$-$C_{10}$ alkylene chain. Since basic gas is generated, $R_1$ is preferably a $C_1$-$C_2$ alkylene chain.

[Chem. 10]

$H_2N—R_2—NH_2$ formula (10)

$R_2$ in the above formula (10) represents a $C_1$-$C_{10}$ alkylene chain. Since basic gas is generated, $R_2$ is preferably a $C_1$-$C_2$ alkylene chain.

[Chem. 11]

formula (11)

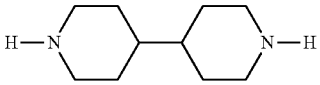

When $R_1$ in the above formula (9) is a $C_1$ or $C_2$ alkylene chain and $R_2$ in the above formula (10) is a $C_1$ or $C_2$ alkylene chain, the above basic gas reacts with the base multiplying agent (B) and further generates basic gas continuously. Basic gas generating upon reaction between basic gas and the base multiplying agent (B) further generates basic gas autocatalytically, which results in exponential generation of basic gas. In addition, carbon dioxide is generated at the same time. Therefore, a large amount of gas is generated even more rapidly.

On the other hand, when $R_1$ in the above formula (9) is a $C_3$-$C_{10}$ alkylene chain and $R_2$ in the above formula (10) is a $C_3$-$C_{10}$ alkylene chain, the compound has a large molecular weight and thus the base multiplying agent does not generate basic gas. However, such a base multiplying agent contains a large number of carboxyl groups on the side chain, thereby generating carbon dioxide gas rapidly and efficiently.

The base multiplying agent is not particularly limited, and 9-fluorenylcarbamate derivatives are preferable. 9-fluorenylcarbamate derivatives may be any of a bifunctional type, a spherical polyfunctional oligomer type, a linear chain high-polymer type, and a siloxane type.

The base multiplying agent (B) is preferably a base multiplying agent (B1) containing a base multiplying group represented by the following formula (12).

[Chem. 12]

formula (12)

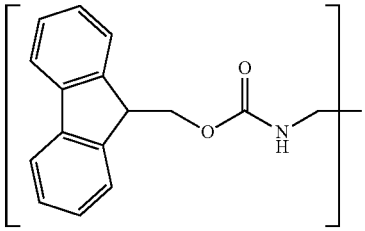

The base multiplying agent (B1) containing the base multiplying group represented by the above formula (12) is degraded by a base multiplication reaction to newly generate an amine. The generated amine then functions as a new catalyst to generate a large number of new amines in a multiplying way. That means that the larger the number of the base multiplying groups represented by the above formula (12) in a molecule, the better the efficiency of the base multiplication reaction in the molecule. Therefore, a larger number of amino groups can be generated.

In a base multiplication reaction in which the base multiplying agent (B1) containing the base multiplying group represented by the above formula (12) is used, an active hydrogen atom is abstracted by a base to form carbanion. Next, a carbamic acid is eliminated and the degradation further proceeds to generate an amino group and carbon dioxide. The amino group serves as a catalyst to accelerate the reaction. The reaction is represented by the following reaction formula (X1).

[Chem. 13]

formula (X1)

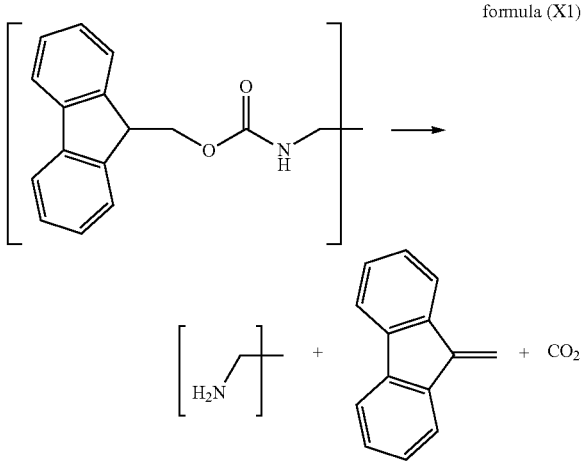

The base multiplying group represented by the above formula (12) is preferably a base multiplying group represented by the following formula (13).

[Chem. 14]

formula (13)

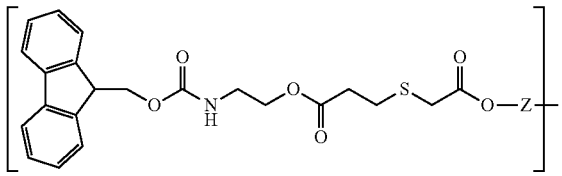

Z in the above formula (13) represents a substituted or unsubstituted alkylene chain.

Specific examples of Z in the above formula (13) include methylene chains, ethylene chains, and propylene chains. Here, Z is preferably an unsubstituted alkylene chain because it leads to an effective base multiplication reaction. Among these alkylene chains, a methylene chain is more preferable as Z because steric hindrance caused by Z tends to be small and the base multiplication reaction tends to occur more effectively.

The base multiplying agent containing the base multiplying group represented by the above formula (13) is preferably a base multiplying agent represented by the following formula (14).

[Chem. 15]

formula (14)

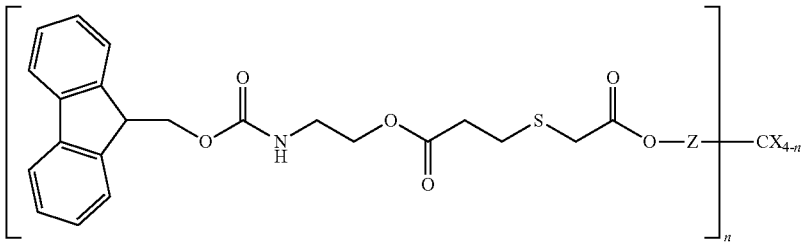

X in the above formula (14) represents hydrogen, a substituted alkyl group, or an unsubstituted alkyl group. Also, Z represents a substituted or unsubstituted alkylene chain, and "n" represents an integer from 1 to 4.

Specific examples of X in the formula (14) include methyl groups, ethyl groups, and propyl groups. X is preferably an unsubstituted alkyl group because it leads to an efficient base multiplication reaction. Further, X is more preferably an ethyl group because it may make the steric hindrance due to X small, thereby leading to a more effective base multiplication reaction.

"n" in the above formula (14) represents an integer from 1 to 4. When the base multiplying agent represented by the above formula (14) contains a plurality of 9-fluorenylcarbamate groups in one molecule, the base multiplication reaction tends to occur even more effectively due to the catalytic activity of the generated base. Therefore, "n" in the above formula (14) is preferably 3 or 4.

Specific examples of the base multiplying agent represented by the above formula (14) include a base multiplying agent (Flu3) represented by the following formula (15) and a base multiplying agent (Flu4) represented by the following formula (16). The base multiplying agents represented by the following respective formulas (15) and (16) can be produced in accordance with a known method.

[Chem. 16]

formula (15)

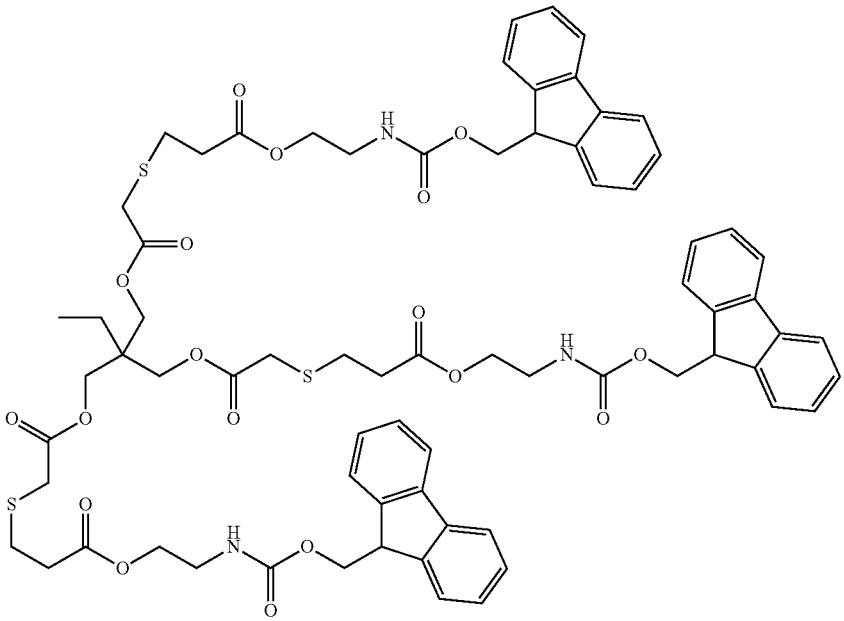

Flu3

-continued

[Chem. 17]

formula (16)

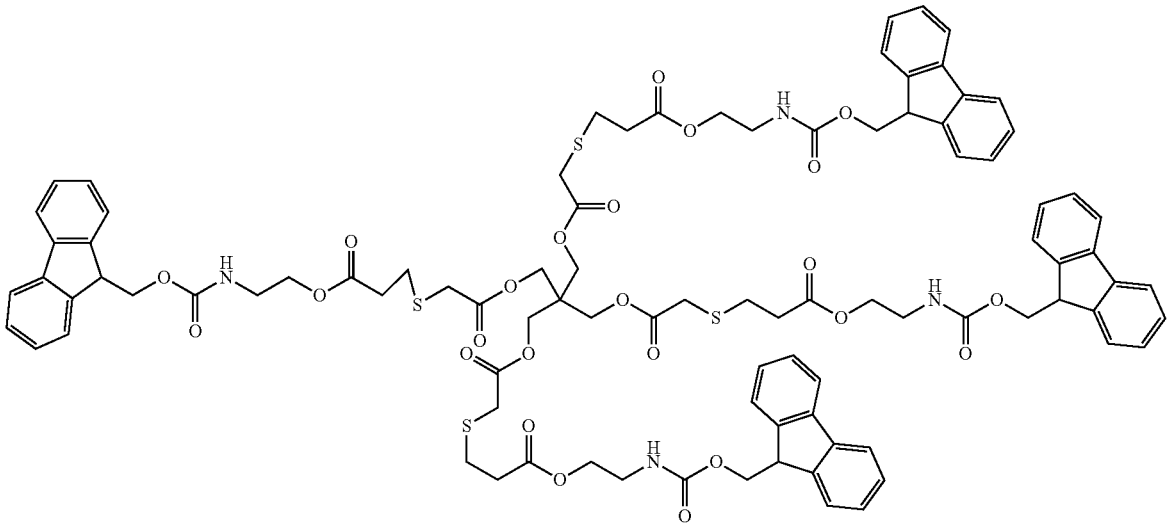

Flu4

The base multiplying agents represented by the respective formulas (15) and (16) each contain a plurality of 9-fluorenylcarbamate groups in one molecule. Accordingly, the base multiplication reaction tends to proceed easily due to the catalytic activity of the generating base. The base multiplying agent is more preferably a base multiplying agent represented by the above formula (15), and still more preferably a base multiplying agent represented by the above formula (16).

A base multiplying agent containing a base multiplying group represented by one of the above formulas (12) and (13) and a base multiplying agent represented by one of the above formulas (14) to (16) are not particularly limited. These base multiplying agents can be synthesized for example by an addition reaction between fluorenyl methanol and an isocyanate derivative, or by an addition reaction between an acrylate monomer containing a fluorenylcarbamate group therein and a polythiol derivative. A base multiplying agent can be easily produced by suitably using a tin catalyst for the former addition reaction or by suitably using a base catalyst for the latter addition reaction.

The base multiplying group represented by the above formula (12) is also preferably a base multiplying group represented by the following formula (17).

[Chem. 18]

formula (17)

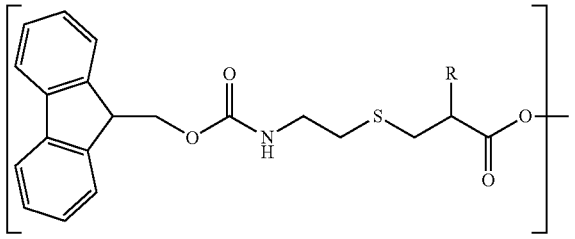

R in the above formula (17) represents a hydrogen atom or a methyl group.

A base multiplying agent containing a base multiplying group represented by the above formula (17) and an unsaturated group represented by the following formula (18) therein may be more preferable as the base multiplying agent (B1) containing a base multiplying group represented by the above formula (12).

[Chem. 19]

formula (18)

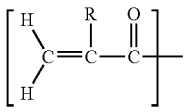

R in the above formula (18) represents a hydrogen atom or a methyl group.

A base multiplying agent containing a base multiplying group represented by the above formula (17) and an unsaturated group represented by the above formula (18) therein is also more preferably used.

A base multiplying agent containing a base multiplying group represented by the above formula (17) can be produced for example by an addition reaction between a compound containing an unsaturated group represented by the above formula (18) and 9-fluorenylmethyl N-(2-mercaptoethyl)carbamate, as shown by the following reaction formula (X2). In this addition reaction, R in the above formula (17) is derived from R of an unsaturated group represented by the above formula (18).

[Chem. 20]

formula (X2)

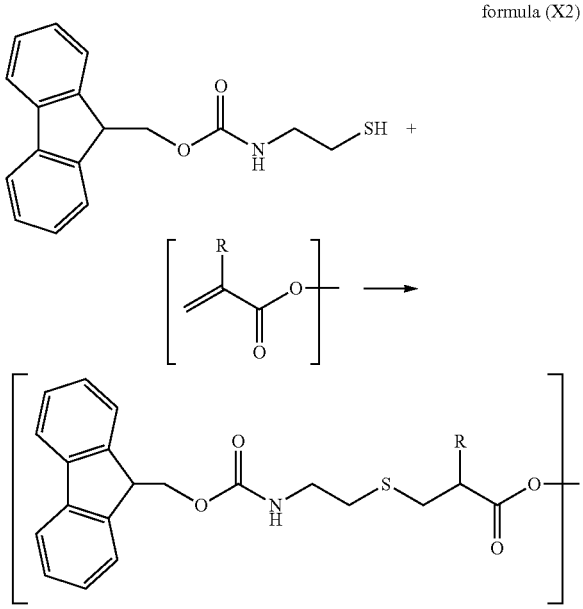

R in the above formula (X2) represents a hydrogen atom or a methyl group.

The compound containing an unsaturated group represented by the above formula (18) is a compound containing an acrylate group or a methacrylate group (hereinafter these groups together are referred to as a (meth)acrylate group).

The compound containing an unsaturated group represented by the above formula (18) may be, for example, a (meth)acrylate monomer or oligomer. A base multiplying agent containing as many base multiplying groups represented by the above formula (18) as possible in one molecule causes an efficient base multiplication reaction. Therefore, a monomer or an oligomer containing at least two (meth)acrylate groups is preferable.

Specific examples of the above polyfunctional (meth)acrylate monomer or (meth)acrylate oligomer include ethylene di(meth)acrylate, triethyleneglycol di(meth)acrylate, epoxy acrylate, and analogues of these compounds.

Further, the above examples can include novolac compounds and known polyfunctional dendritic (meth)acrylates. Each of these compounds may be used alone, or may be blended in use.

In order to increase the number of base multiplying groups represented by the above formula (17) in one molecule of the base multiplying agent, a compound containing at least two unsaturated groups represented by the above formula (18) may be used.

The compound containing at least two unsaturated groups represented by the above formula (18) can be produced for example by adding α-thioglycerol to a compound containing the unsaturated group represented by the above formula (18) so as to cause a Michael addition reaction between them; converting the unsaturated group into a diol-substituted group represented by the following formula (19); and esterifying or urethanizing each hydroxyl group. This reaction can cause, for example, one unsaturated group to be converted into two or four unsaturated groups.

[Chem. 21]

formula (19)

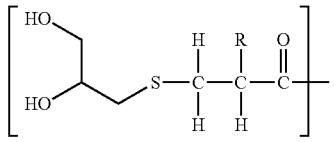

R in the above formula (19) represents a hydrogen atom or a methyl group.

In order to introduce a (meth)acrylate group, which is an unsaturated group, into a hydroxyl group of a polyol compound containing a group represented by the above formula (19), esterification or urethanization can be employed.

The blending amount of the above base multiplying agent (B) is preferably in the range of 20 to 300 parts by weight per 100 parts by weight of the basic compound (A). A blending amount of the base multiplying agent (B) of less than 20 parts by weight may not efficiently cause a chain reaction with the base multiplication reaction. On the other hand, a blending amount of the base multiplying agent (B) of more than 300 parts by weight may cause the base multiplying agent to be saturated in the solvent and precipitated. Also, this may lead to domination of the reaction system by the chain reaction, whereby the reaction may not be stopped at a desired timing and thus controlling the reaction may be difficult.

Aminoalkyl Compound (C)

An amount of 20 to 100 parts by weight of an aminoalkyl compound (C) is preferably blended in 100 parts by weight of the above photobase generator (A). A blending amount of the aminoalkyl compound (C) of less than 20 parts by weight may not result in a sufficient effect of addition of the aminoalkyl compound (C). On the other hand, a blending amount of the aminoalkyl compound (C) of more than 100 parts by weight leads to generation of radicals from the photobase generator in an amount equal to the amount of the photobase generator; accordingly, excessive addition may leave unreacted compounds.

The aminoalkyl compound (C) reacts with an alkyl radical generated upon degradation of the photobase generator (A). This reaction also generates basic gas, further increasing the gas generation efficiency. The basic gas generated thereby further reacts with the base multiplying agent (B), which leads to even more exponential generation of basic gas. Further, carbon dioxide is generated simultaneously with generation of basic gas. Therefore, further use of the aminoalkyl compound (C) in addition to the base multiplying agent (B) enables a further increase in the gas generation efficiency.

The aminoalkyl compound (C) is not particularly limited, and one compound selected from the group consisting of methylamine, ethylamine, butylamine, N-methyl-aminoethyl, N,N-dimethylaminoethyl, N,N-diethylethylenediamine, and N-methylaminobutyl is suitably used. In this case, the gas generation efficiency can be further increased.

A gas generator containing the photobase generator (A) can generate a satisfactory amount of basic gas when irradiated even with a small quantity of light for a short time, even without a photo sensitizer.

The gas generation layer 20 preferably further contains a photo sensitizer. Blending a photo sensitizer in the gas generation layer 20 allows the gas generation layer 20 to generate gas even more rapidly when irradiated with light.

The photo sensitizer is not particularly limited as long as it is a compound transferring energy to the gas generator to promote degradation of a gas generator that generates gas upon irradiation with light. Examples of the photo sensitizer include thioxanthone; benzophenone; acetophenones; Michler's ketone; benzyl; benzoin; benzoin ether; benzil dimethyl ketal; benzoyl benzoate; α-acyloxime ester; tetramethylthiuram monosulfide; aliphatic amines; amines containing an aromatic group; compounds containing nitrogen as a part of the ring, such as piperidine; allylthiourea; o-tolylthiourea; sodium diethyl dithiophosphate; soluble salts of an aromatic sulfinic acid; N,N-disubstituted-p-aminobenzonitrile compounds; tri-n-butylphosphine; N-nitrosohydroxylamine derivatives; oxazolidine compounds; tetrahydro-1,3-oxazine compounds; condensates of diamine and formaldehyde or acetaldehyde; anthracene; derivatives of anthracene; xanthine; N-phenylglycine; cyanine dye porphyrin such as phthalocyanine, naphthocyanine, and thiocyanine; and derivatives of cyanine dye porphyrin. Each of these photo sensitizers may be used alone, or two or more of these may be used in combination.

The blending amount of the photo sensitizer is not particularly limited as long as it exerts a photosensitizing effect. For example, the blending amount of the photo sensitizer is preferably in the range of 0.1 to 50 parts by weight, and more preferably in the range of 1 to 10 parts by weight per 100 parts by weight of the gas generator generating gas upon irradiation with light. A very small amount of the photo sensitizer tends not to exert a sufficient sensitizing effect. On the other hand, a very large amount of the photo sensitizer may inhibit photodegradation of the gas generator.

Further, the gas generation layer 20 may be added with a photodegradable azo compound or peroxide as an aid for gas generation.

Examples of the photodegradable azo compound include azoamide compounds, azonitrile compounds, azoamidine compounds, and cyclic azoamidine compounds. Each of these azo compounds may be used alone, or two or more of these may be used in combination.

Examples of the photodegradable peroxide include benzoyl peroxide, di-t-butyl peroxide, o-dimethylaminobenzoic acid isoamyl, anthraquinones, triazines, azobis(isobutyronitrile), benzoyl peroxide, and cumene peroxide. Examples of the anthraquinones include 2-ethyl anthraquinone, octamethyl anthraquinone, 1,2-benzanthraquinone, and 2,3-diphenylanthraquinone. Examples of the triazines include 2,4-trichloromethyl-(4'-methoxyphenyl)-6-triazine, 2,4-trichloromethyl-(4'-methoxynaphthyl)-6-triazine, 2,4-trichloromethyl-(piperonyl)-6-triazine, and 2,4-trichloromethyl-(4'-methoxystyryl)-6-triazine.

The gas generation layer 20 may be added with a radical scavenger for stopping the continuous generation of gas.

Examples of the radical scavenger include t-butyl catechol, hydroquinone, methyl ether, catalase, glutathione peroxidase, superoxide dismutase enzyme, vitamin C, vitamin E, polyphenols, and linoleic acid.

The gas generator preferably compatibly exists within the gas generation layer 20. This is because high gas generation efficiency can be achieved and the smoothness of the surface of the gas generation layer 20 can be increased.

Note that "being compatible" herein means a state in which the gas generator is finely dispersed or compatibilized to a degree that the gas generator cannot be seen in observation of the gas generation layer 20 with use of an electron microscope.

A gas generator capable of being dissolved in the gas generation layer 20 is preferably chosen as the gas generator so that the gas generator can compatibly exist in the gas generation layer 20. However, the gas generator may be a gas generator that tends not to be dissolved in the gas generation layer 20. In this case, the gas generator is preferably dispersed by a disperser or by adding a dispersing agent.

Further, the binder resin may be a polymeric material such as poly(meth)acrylates, polyesters, polyethylenes, polypropylenes, polystyrenes, polyethers, polyurethanes, polycarbonates, polyamides, and polyimides. Furthermore, copolymers of these materials may be used, or these materials may be used in combination. Among these materials, poly(meth) acrylates are preferable which can further increase the gas generation efficiency. The ultraviolet photoabsorption band of the binder resin is preferably of shorter wavelengths than those of the above photoacid generator, photo sensitizer, and photobase generator.

The binder resin is added to provide various functions to the gas generation layer 20. The binder resin preferably contains, for example, a pressure-sensitive adhesive resin. Blending a pressure-sensitive adhesive resin as a binder resin to the gas generation layer 20 makes it possible to increase the adhesion and the pressure-sensitive adhesion between the gas generation layer 20 and the substrate 10.

In the present embodiment, a pressure-sensitive adhesive resin preferably does not cure due to an external stimulus provided to the gas generation layer 20. If a pressure-sensitive adhesive resin does not cure due to an external stimulus, the gas generation layer 20 can retain high adhesion and pressure-sensitive adhesion to the substrate 10 even after starting to receive an external stimulus. The pressure-sensitive adhesion resin, for example, preferably is not cross-linked due to an external stimulus.

Specific examples of the pressure-sensitive adhesive resin include rubber pressure-sensitive adhesive resins, acrylic pressure-sensitive adhesive resins, silicone pressure-sensitive adhesive resins, urethane pressure-sensitive adhesive resins, stylene-isoprene-stylene copolymer pressure-sensitive adhesive resins, stylene-butadiene-stylene copolymer pressure-sensitive adhesive resins, epoxy pressure-sensitive adhesive resins, and isocyanate pressure-sensitive adhesive resins. Among these, acrylic pressure-sensitive adhesive resins are preferable.

Figure 23:
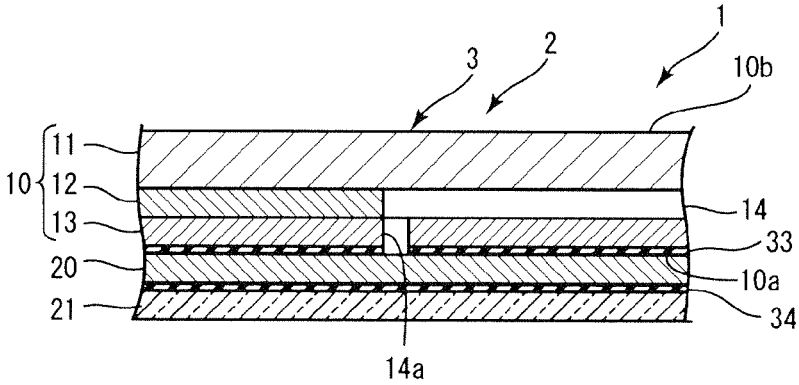
FIG. 23 is a cross-sectional view of a microfluidic device in an alternative embodiment 13.

The binder resin, however, is not required to contain a pressure-sensitive adhesive resin. If the binder resin does not contain a pressure-sensitive adhesive resin, the substrate 10 and the gas generation layer 20 may be attached to each other by respectively disposing pressure-sensitive adhesive layers 33 and 34 between the substrate 10 and the gas generation layer 20 and between the gas generation layer 20 and the barrier layer 21, as illustrated in FIG. 23.

Further, the form of the gas generation layer in the present invention is not limited to a gas generation film. The gas generation layer may be, for example, a porous material in a plate or film form, which has a gas generator attached thereto or impregnated therein. In this case, gas generating in the gas generation layer is rapidly led to the micro-channel through a plurality of pores formed in the porous material. This makes it possible to further increase the liquid pumping efficiency of the microfluidic system. Further, in this case, the barrier layer 21 is particularly preferably provided so that gas generating from the gas generation layer 20 is suitably led to the micro-channel 14.

The porous material is not particularly limited. Specific examples of the porous material include nonwoven fabrics and woven fabrics which are aggregates of a plurality of fibers; and foams.

Figure 24:
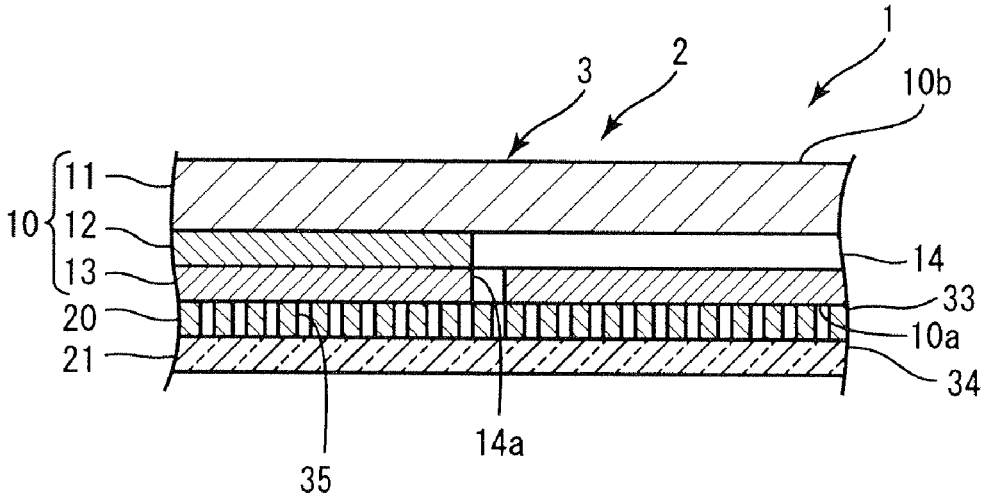
FIG. 24 is a cross-sectional view of a microfluidic device in an alternative embodiment 14.

Further, the gas generation layer is preferably processed into a shape facilitating supply of gas to the micro-channel so that gas generating in the gas generation layer is rapidly supplied to the micro-channel. For example, the gas generation layer 20 may have multiple through holes 35 in a matrix state formed therein which penetrate the gas generation layer 20 in the thickness direction of the gas generation layer 20, as illustrated in FIG. 24. In this case, the diameter of the through holes 35 is preferably smaller than the diameter of the micro-channel 14. In this case, too, the barrier layer 21 is particularly preferably provided so that gas generating from the gas generation layer 20 is suitably led to the micro-channel 14.

If the gas generation layer is to contain a binder resin, the blending amount of the azo compound or the azide compound is preferably 5 to 100 parts by weight, and more preferably 10 to 50 parts by weight per 100 parts by weight of the binder resin. A very small blending amount of the azo compound or the azide compound may result in a very small gas generation amount due to an external stimulus. On the other hand, a very large blending ratio of the azo compound or the azide compound may lead to undissolved compounds remaining in the binder resin.

Further, the blending amount of the above photoacid generator is preferably 2 to 150 parts by weight, and more preferably 10 to 100 parts by weight per 100 parts by weight of the binder resin. Also, the blending amount of the acid stimulation gas generator is preferably 2 to 150 parts by weight, and more preferably 10 to 100 parts by weight per 100 parts by weight of the binder resin. Very small blending amounts of the photoacid generator and the acid stimulation gas generator may result in an insufficient gas generation amount due to irradiation with light. On the other hand, very large blending amounts of the photoacid generator and the acid stimulation gas generator may result in undissolved photoacid generator and the acid stimulation gas generator remaining in the binder resin.

The blending amount of the photobase generator is 20 to 500 parts by weight per 100 parts by weight of the binder resin. A very small blending amount of the photobase generator may result in an insufficient gas generation amount due to irradiation with light. On the other hand, a very large blending amount of the photobase generator may result in incomplete dissolution of the photobase generator in the binder resin.

The blending amount of the base multiplying agent is preferably in the range of 20 to 300 parts by weight per 100 parts by weight of the photobase generator. An amount of the base multiplying agent of less than 20 parts by weight may not efficiently cause a chain reaction with the base multiplication reaction. On the other hand, more than 300 parts by weight of the base multiplying agent may cause the base multiplying agent to be saturated in the solvent and precipitated. Also, this may lead to domination of the reaction system by the chain reaction, whereby the reaction may not be stopped at a desired timing and thus controlling the reaction may be difficult.

The blending amount of the aminoalkyl compound is preferably in the range of 20 to 100 parts by weight per 100 parts by weight of the photobase generator. A blending amount of the aminoalkyl compound of less than 20 parts by weight may not result in a sufficient effect of addition of the aminoalkyl compound. On the other hand, a blending amount of the aminoalkyl compound of more than 100 parts by weight leads to generation of radicals from the photobase generator in an amount equal to the amount of the photobase generator; accordingly, excessive addition may leave unreacted compounds.

The acrylic pressure-sensitive adhesive resin is a polymer having pressure-sensitive adhesion at normal temperature. An acrylic pressure-sensitive adhesive resin can be produced for example by copolymerizing the following monomers by a general method: at least one of an alkyl acrylate and an alkyl methacrylate that contain an alkyl group generally having 2-18 carbon atoms, as the main monomer; a functional-group-containing monomer; and another copolymerizable modifying monomer according to need. The weight-average molecular weight of the functional-group-containing (meth) acrylic polymer is generally about 200,000 to 2,000,000.

If the polarity of the substrate 10 is low as in the case where the substrate 10 is substantially made of an organic siloxane compound, the pressure-sensitive adhesive resin with a low polarity is preferably used.

Use of a pressure-sensitive adhesive resin having a low polarity makes it possible to increase bonding strength between the substrate 10 and the gas generation layer 20 even when the substrate 10 has a low polarity.

Examples of the pressure-sensitive adhesive resin with a low polarity include pressure-sensitive adhesive resins with a low-polarity side chain, such as alkyl pendant compounds and fluorine-substituted alkyl pendant compounds; and silicone pressure-sensitive adhesive resins.

Examples of the alkyl pendant compound include long-chain alkyl acrylate polymers and long-chain alkyl-modified polymers. Specific examples of the long-chain alkyl acrylate polymer include copolymers of, for example, a $C_{12}$ or higher long-chain alkyl acrylate such as stearyl acrylate; butyl acrylate or acrylonitrile as a film-forming component; and an acrylic acid or maleic anhydride as a functional group component that provides a bonding property to a tape support. Specific examples of the long-chain alkyl-modified polymer include polymers produced by introducing a pendant group into a polymer with a high polymerization degree, such as polyvinyl alcohol, with use of a long-chain alkyl component such as alkyloyl chloride or alkyl isocyanate.

Examples of the fluorine-substituted alkyl pendant compound include alkyl(meth)acrylates containing a $CF_3$ group or a $CH_3$ group. Alternatively, the fluorine-substituted alkyl pendant compound may be a copolymer of 2,2,2-trifluoroethyl(meth)acrylate or 2,2,3,3-tetrafluoropentyl acrylate; butyl acrylate or acrylonitrile as a film-forming component; and an acrylic acid or maleic anhydride as a functional group component that provides a bonding property to a tape support.

Specific examples of the silicone pressure-sensitive adhesive resin include a mixture containing silicone rubber and silicone resin. Specific examples of the silicone rubber include straight-chain organopolysiloxane represented by the following formula (1). Specific examples of the silicone resin include silicone resin represented by the following formula (2).

[Chem. 22]

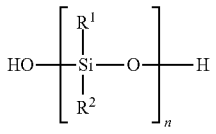

(1)

$R^1$ and $R^2$ in the above formula (1) each are a methyl group or a phenyl group. Also, "n" is 5,000 to 20,000.

[Chem. 23]

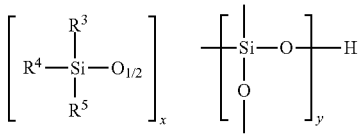

(2)

$R^3$, $R^4$, and $R^5$ in the above formula (2) each are a methyl group or a phenyl group. Also, "x" is 2,000 to 7,500, and "y" is 2,300 to 13,500.

The silicone rubber may have cross-linking sites. Examples of the crosslinking method of the silicone rubber include, but are not limited to, a method utilizing a peroxide such as benzoyl peroxide, and a method utilizing a hydrosilylation reaction.

The solubility parameter (SP value) of the silicone pressure-sensitive adhesive resin is not particularly limited, and is preferably 6.0 to 11.0. A value falling in such a range can further increase the bonding strength between the low-polarity substrate 10 and the gas generation layer 20. Here, the solubility parameter (SP value) is a square root of the cohesive energy of the material, and is an indicator of the solubility of the resin to the solvent and the compatibility or bonding property between the resins.

Further, the pressure-sensitive adhesive resin may contain a silane coupling agent if the substrate 10 has a low polarity. Even in this case where the pressure-sensitive adhesive resin contains a silane coupling agent, the bonding strength between the low-polarity substrate 10 and the gas generation layer 20 can be increased. Specific examples of the silane coupling agent include vinylsilane compounds such as vinyltrimethoxysilane and vinyltriethoxysilane; epoxysilane compounds such as 2-(3,4-epoxycyclohexyl)ethyltrimethoxysilane and 3-glycidoxypropyltrimethoxysilane; methacrylosilane compounds such as 3-methacryloxypropylmethyldimethoxysilane and 3-methacryloxypropyltrimethoxysilane; and aminosilane compounds such as N-2-(aminoethyl)-3-aminopropylmethyldimethoxysilane and N-2-(aminoethyl)-3-aminopropyltrimethoxysilane.

Further, a bonding layer may be provided between the substrate 10 and the gas generation layer 20 if the substrate 10 has a low polarity. This makes it possible to increase the bonding strength between the substrate 10 and the gas generation layer 20. More specifically, if the substrate 10 is substantially made of an organic siloxane compound and the gas generation layer 20 contains an acrylic pressure-sensitive adhesive, a bonding layer substantially made of polyethylene terephthalate (PET) is preferably provided between the substrate 10 and the gas generation layer 20.

In order to adjust cohesion of a pressure-sensitive adhesive, the binder resin may be optionally added with an appropriate crosslinking agent that is blended in a general pressure-sensitive adhesive, such as an isocyanate compound, a melamine compound, or an epoxy compound. Further, the binder resin may be added with known additives such as a plasticizer, a resin, a surfactant, wax, and a fine-particle filler.

The gas generation layer 20 may have a single or plurality of films. That is, the gas generation layer 20 may be formed on the substrate 10 by film formation, or the gas generation layer 20 in a film form may be attached on the substrate 10.

The barrier layer 21 is provided on the reverse side of the substrate 10 side of the gas generation layer 20. The barrier layer 21 is for preventing gas generating in the gas generation layer 20 from flowing toward the barrier layer 21 side. Accordingly, the barrier layer 21 is preferably a layer less likely to allow the gas generating in the gas generation layer 20 to pass therethrough, and is preferably a layer substantially not allowing the gas generating in the gas generation layer 20 to pass therethrough.

Further, the barrier layer 21 preferably allows light to pass therethrough if the gas generation layer 20 generates gas upon irradiation with light.

The barrier layer 21 may be a membrane, a film, or a substrate which is made of resin, or may be a membrane, a film, or a substrate which is made of glass. Examples of the material of the barrier layer 21 include polyacrylates, polyolefins, polycarbonates, vinyl chloride resins, ABS resins, polyethylene terephthalate (PET) resins, nylon resins, urethane resins, polyimide resins, and glass.

The barrier layer 21 may be formed on the gas generation layer 20 by film formation, or, the barrier layer 21 in a film form may be attached on the gas generation layer 20. Alternatively, the gas generation layer 20 may be previously formed on the barrier layer 21 by film formation, and then the reverse side of the barrier layer 21 side of the gas generation layer 20 may be attached on the substrate 10. In this case, the method of film-depositing the gas generation layer 20 is not particularly limited. For example, the gas generation layer 20 may be film-deposited by coating or extrusion molding.

The surface on the gas generation layer 20 side of the barrier layer 21 is preferably anchored. Anchoring the surface on the gas generation layer 20 side of the barrier layer 21 can prevent generation of gas between the barrier layer 21 and the gas generation layer 20 and prevent accumulation of generating gas between the barrier layer 21 and the gas generation layer 20. Therefore, separation of the barrier layer 21 and the gas generation layer 20 can be prevented. The method of anchoring can be the same as the above described method.

The thickness of the barrier layer 21 is not particularly limited. The thickness is preferably 10 μm to 100 μm, and more preferably 25 μm to 75 μm.

As described above, the gas generation layer 20 is provided so as to cover the opening 14*a* of the micro-channel 14 in the present embodiment. This causes gas, which is generated in the gas generation layer 20 upon provision of an external stimulus to the gas generation layer 20, to be provided to the micro-channel 14. Accordingly, the micro-pump system of the present embodiment does not require a micro-pump chamber that a micro-pump system described for example in the Patent Document 1 requires. Therefore, the micro-pump system 2 and thus the microfluidic device 1 can be downsized according to the present embodiment.

Further, the microfluidic device 1 can be produced more easily than the microfluidic device described in Patent Document 1 because the microfluidic device 1 does not require formation of a micro-pump chamber in the substrate thereof and simply requires formation of the gas generation layer 20. Production of the microfluidic device 1 is even easier particularly when a gas generation film is used as the gas generation layer 20.

Further, in the present embodiment, adjusting the opening space of the opening 14*a* also allows adjustment of the amount of gas being supplied to the micro-channel 14.

The barrier layer 21 is provided on the reverse side of the substrate 10 side of the gas generation layer 20 in the present embodiment. This makes it possible to efficiently supply gas generating in the gas generation layer 20, to the micro-channel 14. Accordingly, high gas pressure can be easily attained in the micro-channel 14.

The gas generation layer 20 of the present embodiment contains a binder. This makes it possible to provide various functions to the gas generation layer 20. For example, the gas generation layer 20 can increase its pressure-sensitive adhesion to the substrate 10 by containing a pressure-sensitive adhesive resin as a binder. This allows, for example, prevention of peeling of the gas generation layer 20 from the substrate 10 upon generation of gas. Hence, even higher gas pressure can be attained in the micro-channel 14.

The gas generation layer 20 can maintain high pressure-sensitive adhesion to the substrate 10 even after starting to receive an external stimulus by containing as a binder a pressure-sensitive adhesive resin that does not cure due to an external stimulus. Accordingly, even higher gas generation pressure can be attained in the micro-channel 14.

Hereinafter, other examples of preferred embodiments of the present invention are described. In the following description, members having a function substantially common to that in the first embodiment are provided with common symbols, and thus descriptions thereof are omitted.

Second Embodiment

Figure 2:
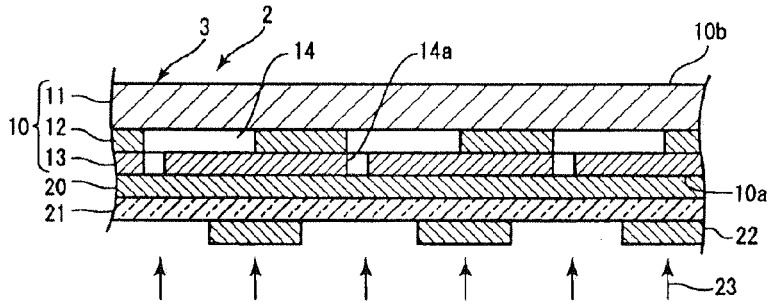
FIG. 2 is a cross-sectional view of a microfluidic device according to a second embodiment.

The first embodiment was an example in which the microfluidic device 1 has only one gas generation portion 3 formed therein. However, in the present invention, the microfluidic device 1 may have a plurality of the gas generation portions 3 as illustrated in FIG. 2. In other words, the microfluidic device 1 may have a plurality of micro-channels 14. In this case, only one gas generation layer 20 may be provided in common with a plurality of the gas generation portions 3.

If, as in the present embodiment, the plurality of the gas generation portions 3 are formed in a matrix state and the gas generation layer 20 generates gas upon irradiation with light, a single or plurality of light shield layers 22 may be provided, in a plane view, between the adjacent openings 14*a* so as to shade light 23 irradiated to the gas generation layer 20.

Provision of the light shield layer 22 facilitates control of light irradiation to the portion corresponding to each opening 14*a* of the gas generation layer 20. More specifically, for example, provision of no light shield layer 22 may lead to light irradiation of all the portions corresponding to the plurality of the adjacent openings 14*a* of the gas generation layer 20. It is thus difficult to radiate light to only a portion corresponding to one opening 14*a* of the gas generation layer 20. In contrast, the light shield layers 22 divide the portions corresponding to the adjacent openings 14*a* of the gas generation layer 20 in the present embodiment. This makes it possible to prevent the light, which is meant to irradiate the portion corresponding to a certain opening 14*a* of the gas generation layer 20, from irradiating a portion corresponding to an opening 14*a* adjacent to the above certain opening 14*a* of the gas generation layer 20. Therefore, separately controlling the respective gas generation portions 3 is made easy.

The light shield layer 22 preferably has an opening or a light transmission portion formed at a portion corresponding to each opening 14*a*. In other words, the portions corresponding to the respective openings 14*a* of the gas generation layer 20, in a plane view, are preferably separated from each other in the light shield layer 22. The reason for this is that such arrangement makes it possible to effectively prevent the light, which is meant to irradiate the portion corresponding to a certain opening 14*a* of the gas generation layer 20, from irradiating a portion corresponding to an opening 14*a* adjacent to the above certain opening 14*a* of the gas generation layer 20.

The present embodiment is particularly effective when the distance between the adjacent openings 14*a* is short. In other words, multiple gas generation portions 3 can be disposed densely according to the present embodiment.

Third Embodiment

Figure 3:
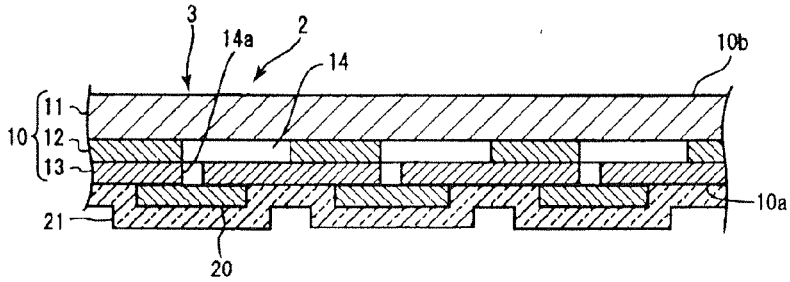
FIG. 3 is a cross-sectional view of a microfluidic device according to a third embodiment.

The second embodiment has described an example in which only one gas generation layer 20 is provided in common with a plurality of the gas generation portions 3. However, as illustrated in FIG. 3, one gas generation layer 20 may be provided for each of the plurality of the gas generation portions 3. In this case, the gas generation layer 20 and the substrate 10 are not necessarily attached to each other. For example, the barrier layer 21 and the substrate 10 may be adhered at parts between adjacent gas generation layers 20 and then fixed to each other such that each of the gas generation layers 20 is disposed between the barrier layer 21 and the substrate 10.

Fourth Embodiment

Figure 4:
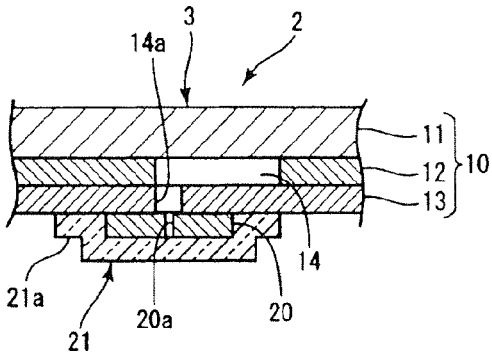
FIG. 4 is a cross-sectional view of a microfluidic device according to a fourth embodiment.

FIG. 4 is a cross-sectional view of a microfluidic device according to a fourth embodiment. The barrier layer 21 of the present embodiment, as illustrated in FIG. 4, is joined to the substrate 10, on the entire periphery of a periphery portion 21*a* positioned over the outer periphery of the gas generation layer 20. This produces a substantially airtight space between the substrate 10 and the barrier layer 21. In this airtight space, the gas generation layer 20 is disposed.

The gas generation layer 20 may or may not be adhered to or pressure-sensitively adhered to the substrate 10. The gas generation layer 20 has a continuous hole 20*a* formed therein. The continuous hole 20*a* is connected to the opening 14*a*.

For example, if no continuous hole 20*a* is formed, gas generating on the reverse side of the substrate 10 side of the gas generation layer 20 is supplied to the micro-channel 14 through the inside of the gas generation layer 20. Accordingly, the feed efficiency of gas to the micro-channel 14 tends to be low. In contrast, the continuous hole 20*a* is formed in the present embodiment, and therefore gas generating on the reverse side of the substrate 10 side of the gas generation layer 20 is supplied to the micro-channel 14 through the continuous hole 20*a*. Accordingly, gas is efficiently supplied to the micro-channel 14, which also makes it possible to make the gas generation layer 20 smaller.

Fifth Embodiment

Figure 5:
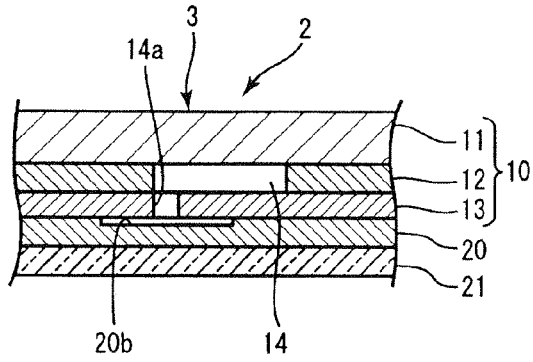
FIG. 5 is a cross-sectional view of a microfluidic device according to a fifth embodiment.

FIG. 5 is a cross-sectional view of a microfluidic device according to a fifth embodiment. The gas generation layer 20 may have a single or plurality of grooves 20*b* that are connected to the opening 14*a*, as illustrated in FIG. 5. This allows efficient supply of gas generating in a portion located away from the opening 14*a* of the gas generation layer 20, to the micro-channel 14.

Figure 6:
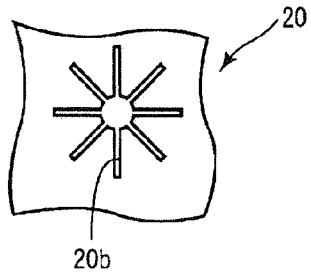
FIG. 6 is a plane view of a gas generation layer in the fifth embodiment.

For example, the gas generation layer 20 preferably has a plurality of the grooves 20*b* radially extending from the portion corresponding to the opening 14*a*, as illustrated in FIG. 6. This makes it possible to supply gas to the micro-channel 14 from a wider area of the gas generation layer 20.

Figure 7:
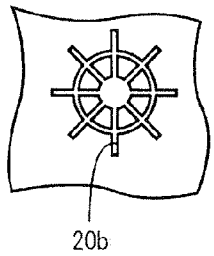
FIG. 7 is a plane view of a gas generation layer in an alternative embodiment 1.

The gas generation layer 20 may further have a orbicular or horseshoe-shaped groove that connects the plurality of radially formed grooves 20*b*, as illustrated in FIG. 7. Note that the number and shape of the grooves 20*b* to be formed are not limited in the present invention.

The gas generation layer 20 may have an aperture penetrating therethrough in the thickness direction, in place of the groove 20*b*.

Further, provision of a rough surface as the surface on the substrate 10 side of the gas generation layer 20 may be an alternative to formation of the groove 20*b* or an aperture. Even in this case, gas generating in a portion located away from the opening 14*a* of the gas generation layer 20 can be efficiently supplied to the micro-channel 14.

Figure 8:
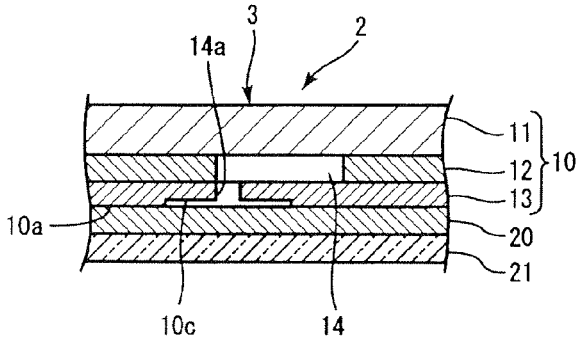
FIG. 8 is a cross-sectional view of a microfluidic device according to an alternative embodiment 2.
Figure 9:
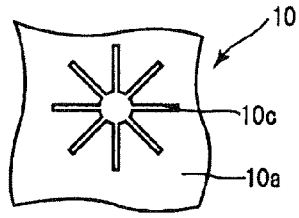
FIG. 9 is a plane view of a substrate in the alternative embodiment 2.

Furthermore, formation of a groove 10*c* on a surface 10*a* of the substrate 10, as illustrated in FIGS. 8 and 9, may be an alternative to formation of the groove 20*b* in the gas generation layer 20 as in the fifth embodiment. Alternatively, the groove 20*b* may be formed in the gas generation layer 20 and, at the same time, the groove 10*c* may be formed on the surface 10*a* of the substrate 10.

Example 1

First, an acrylic copolymer (weight-average molecular weight of 700,000) containing 96.5 parts by weight of 2-ethylhexyl acrylate, 3 parts by weight of acrylic acid, and 0.5 parts by weight of 2-hydroxyethyl acrylate was prepared.

Next, 100 parts by weight of the acrylic copolymer was mixed with 200 parts by weight of ethylacetate as a solvent, and 5 parts by weight of isocyanate compound (product name: CORONATE L45, produced by Nippon Polyurethane Industry Co., Ltd.) as a crosslinking agent, so that a pressure-sensitive resin binder solution was prepared.

The pressure-sensitive adhesive resin binder solution was added with 2,3,4,4'-tetrahydroxybenzophenone as a photoacid generator and with sodium bicarbonate as an acid stimulation gas generator, whereby a photoresponsive gas generating material was produced. Here, the blending amounts of 2,3,4,4'-tetrahydroxybenzophenone and sodium bicarbonate were respectively 35 parts by weight and 75 parts by weight per 100 parts by weight of acrylic copolymer.

The photoresponsive gas generating material was applied, by casting, on an anchored PET film having a thickness of 50 μm, and was then dried so that a photoresponsive gas generation film was produced. The photoresponsive gas generation film after drying had a thickness of about 30 μm.

Example 2

A photoresponsive gas generation film was produced in the same way as that in Example 1 except that the pressure-sensitive adhesive resin binder solution of Example 1 was added with 2,2'-azobis(N-butyl-2-methylpropionamide) as a photo gas generator, in place of the above photoacid generator and the acid stimulation gas generator. Here, the blending amount of 2,2'-azobis(N-butyl-2-methylpropionamide) was 20 parts by weight per 100 parts by weight of the acrylic copolymer.

Example 3

A photoresponsive gas generation film was produced in the same way as that in Example 2 except that 3-azidomethyl-3-methyloxetane was used as the photo gas generator.

(Evaluation)

Polymethylmethacrylate (PMMA) plates each having a 1-mm diameter through hole formed therein were prepared which had a size of 50 mm×50 mm and a thickness of 5 mm. Each photoresponsive gas generation film produced in Examples 1 to 3 was attached to each PMMA plate by a hand roller.

A gas-generation quantitative measurement device provided with a tube through which gas passes, and with a measuring pipette attached to an end of the tube for measurement of the amount of gas was prepared. The other end of the tube of the gas-generation quantitative measurement device was connected to an opening on the reverse side of photoresponsive gas generation film side of the through hole formed in the PMMA plate. Note that the gas-generation quantitative measurement device has a default setting of a state in which the measuring pipette is filled with water up to the reference line thereof by receiving water from one end of the tube; from this default state, the gas-generation quantitative measurement device measures changes in water level which are caused by the gas generating from the film.

Next, the gas generation amount was measured when the photoresponsive gas generation film was irradiated with an infrared light having a wavelength of 365 nm from a high pressure mercury lamp at a light irradiation strength of 24 $mW/cm^2$ (365 nm). Further, 200 seconds after irradiation with the infrared light, the total amount of the photoacid generator and the acid stimulation gas generator, and the gas generation amount per 1 g of the photo gas generator were measured. The measured values were evaluated based on the following criteria.

[Criteria for Evaluation of Gas Generation Amount]

+++: Gas generation amount per 1 g of the photo gas generator is 1.5 mL or larger ++: Gas generation amount per 1 g of the photo gas generator is 1.0 mL or larger and is smaller than 1.5 mL +: Gas generation amount per 1 g of the photo gas generator is 0.5 or larger and is smaller than 1.0 mL −; Gas generation amount per 1 g of the photo gas generator is less than 0.5 mL The results are shown in the following.

[Gas Generation Amount Evaluation Results]

Example 1: ++

Example 2 +++

Example 3: +++

Alternative Examples 3 to 12

The above embodiments described cases in which only one opening 14*a* was formed per one micro-channel 14. However, the present invention is not limited to this structure. For example, a plurality of the openings 14*a* may be formed per one micro-channel 14. Further, the substrate 10 may have a plurality of the micro-channels 14 connected to one another. FIGS. 10 to 22 each illustrate a formation example of the micro-channel 14.

Figure 10:
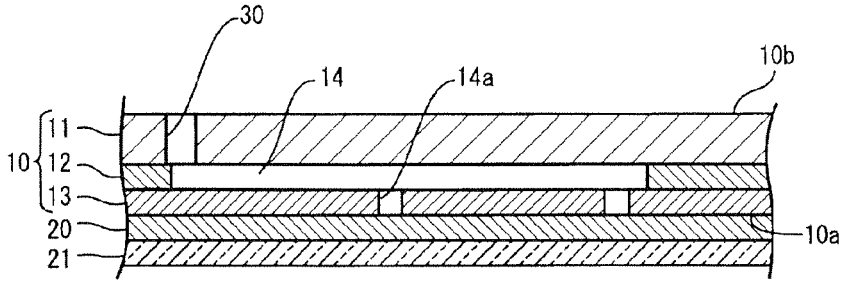
FIG. 10 is a schematic cross-sectional view of a microfluidic device according to an alternative embodiment 3.
Figure 11:
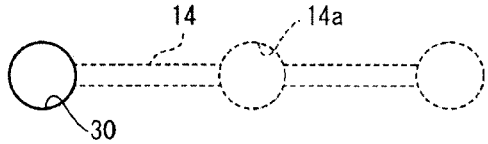
FIG. 11 is a schematic plane view illustrating a structure of a micro-channel in the alternative embodiment 3.

FIGS. 10 and 11 illustrate an example in which two openings 14*a* are formed for one micro-channel 14. A gas outlet 30, which is for discharging gas from the micro-channel 14, is formed at an end portion of the micro-channel 14.

Figure 12:
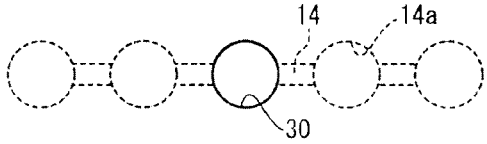
FIG. 12 is a schematic plane view illustrating a structure of a micro-channel in an alternative embodiment 4.

FIG. 12 illustrates an example in which four openings 14*a* are linearly formed for one micro-channel 14. The gas outlet 30 is formed at a portion between adjacent openings 14*a* of the micro-channel 14.

Figure 13:
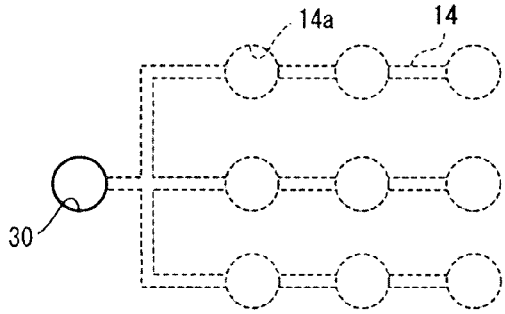
FIG. 13 is a schematic plane view illustrating a structure of a micro-channel in an alternative embodiment 5.

FIG. 13 illustrates an example in which a plurality of the micro-channels 14 arranged in parallel with each other are connected to one gas outlet 30. More specifically, three micro-channels 14 arranged in parallel with each other are connected to one gas outlet 30. Each micro-channel 14 has a plurality of the openings 14*a* formed therein.

Figure 14:
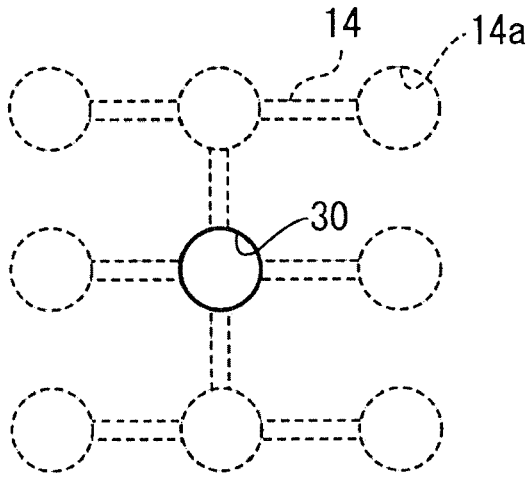
FIG. 14 is a schematic plane view illustrating a structure of a micro-channel in an alternative embodiment 6.

FIG. 14 illustrates an example in which four micro-channels 14 are connected to one gas outlet 30. At least one of the plurality of the micro-channels 14 is branched.

Figure 15:
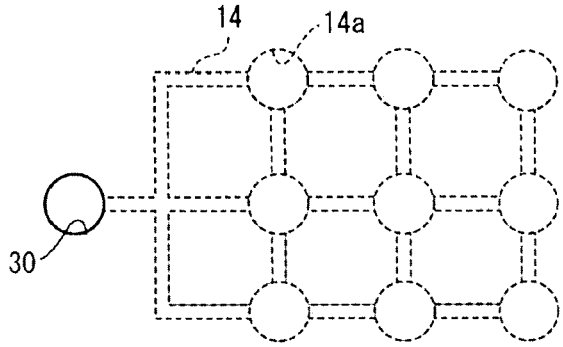
FIG. 15 is a schematic plane view illustrating a structure of a micro-channel in an alternative embodiment 7.

FIG. 15 illustrates an example in which a plurality of the openings 14*a* are connected in a mesh pattern by the micro-channels 14.

Figure 16:
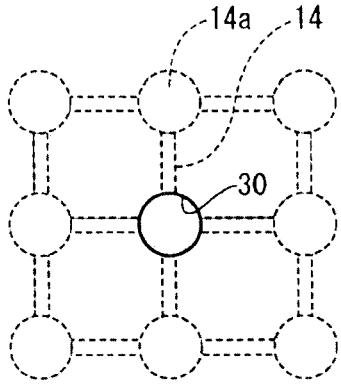
FIG. 16 is a schematic plane view illustrating a structure of a micro-channel in an alternative embodiment 8.

FIG. 16 illustrates an example in which the gas outlet 30 is formed at the center portion of the micro-channels 14 formed in a mesh pattern.

Figure 17:
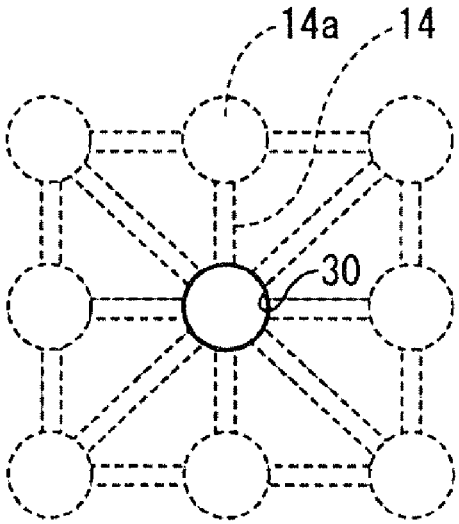
FIG. 17 is a schematic plane view illustrating a structure of a micro-channel in an alternative embodiment 9.
Figure 18:
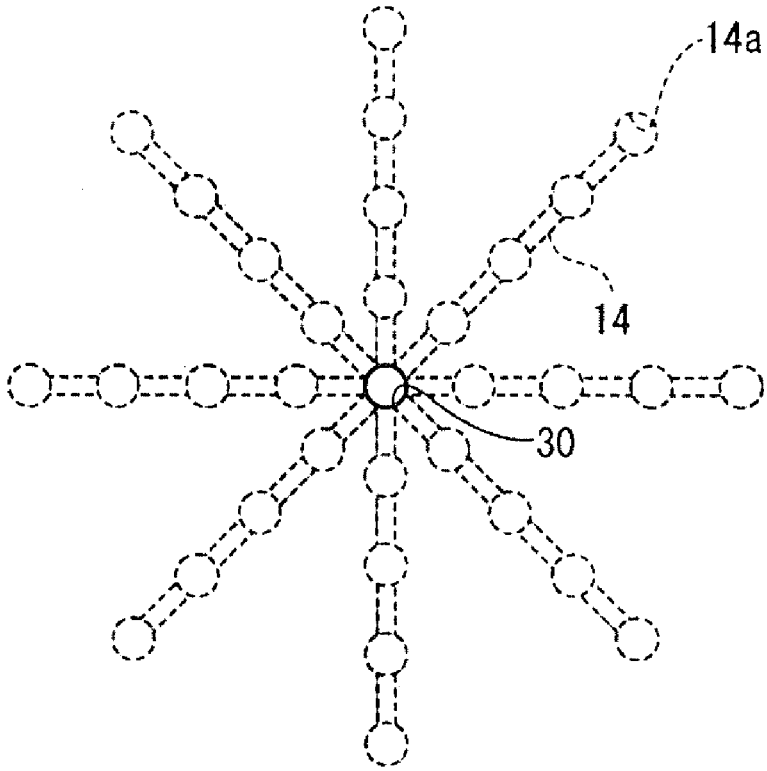
FIG. 18 is a schematic plane view illustrating a structure of a micro-channel in an alternative embodiment 10.

FIGS. 17 and 18 illustrate an example in which one gas outlet 30 is connected with a plurality of the micro-channels 14 radially extending from the gas outlet 30. FIG. 17 illustrates an example in which each micro-channel has one opening 14*a* formed therein and the respective micro-channels are connected to one another. FIG. 18 illustrates an example in which each micro-channel 14 has a plurality of the openings 14*a* linearly formed at equal intervals.

Figure 19:
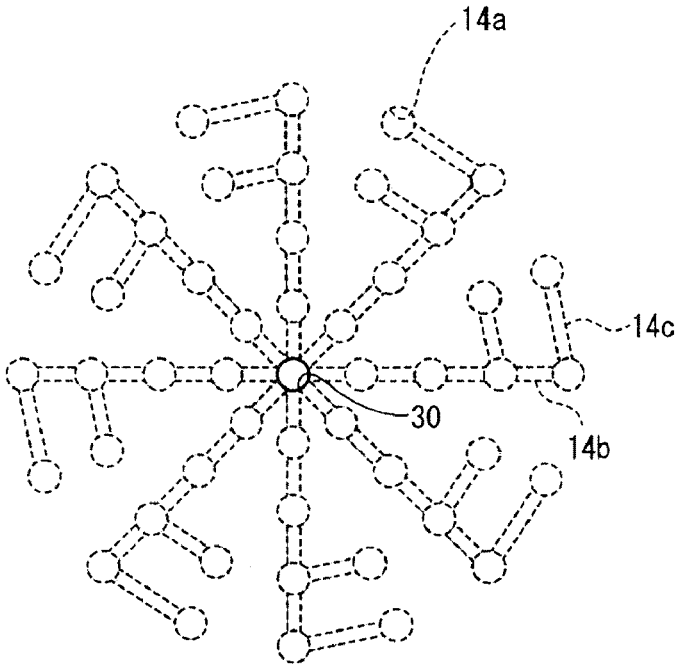
FIG. 19 is a schematic plane view illustrating a structure of a micro-channel in an alternative embodiment 11.
Figure 20:
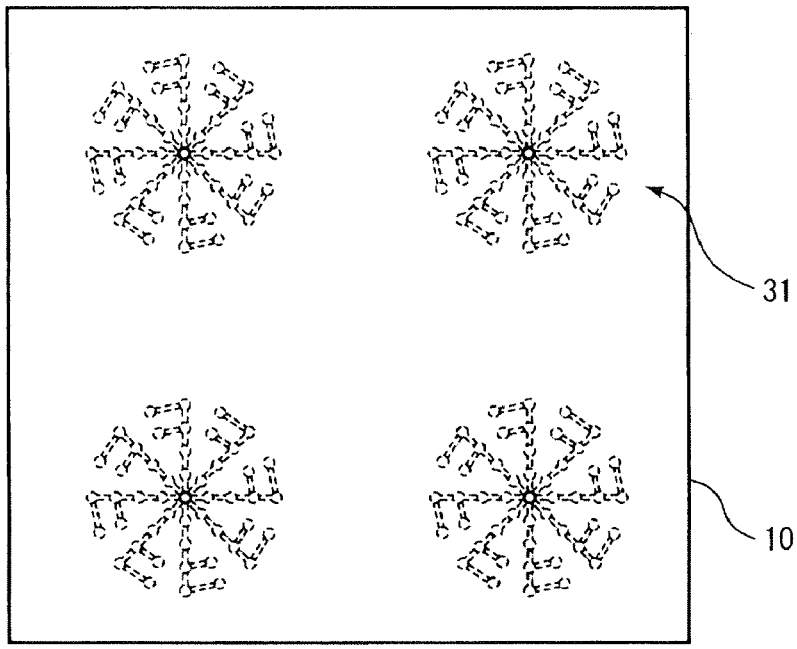
FIG. 20 is a schematic plane view of a microfluidic device in the alternative embodiment 11.

FIGS. 19 and 20 also illustrate an example in which one gas outlet 30 is connected with a plurality of the micro-channels 14 radially extending from the gas outlet 30. In FIG. 19, each micro-channel 14 has a main channel 14*b* connected to the gas outlet 30, and a sub channel 14*c*. The sub channel 14*c* connected to the main channel 14*b* are arranged in parallel with each other. Each of the plurality of the sub channels 14*c* has the opening 14*a* formed therein. In FIG. 20, a plurality of micro-channel groups 31 each having the plurality of the micro-channels 14 connected to one gas outlet 30 are formed in the substrate 10.

Figure 21:
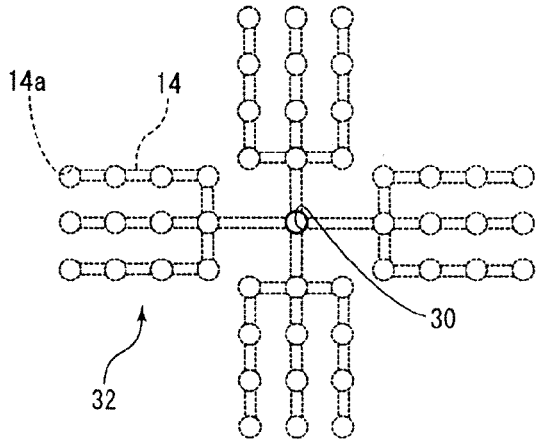
FIG. 21 is a schematic plane view illustrating a structure of a micro-channel in an alternative embodiment 12.
Figure 22:
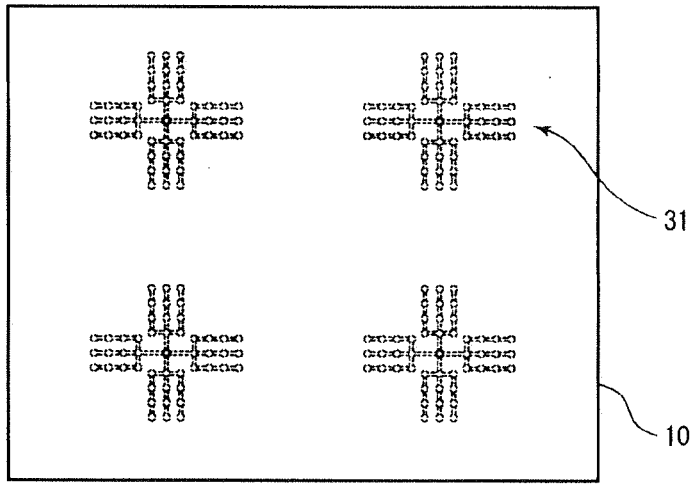
FIG. 22 is a schematic plane view of a microfluidic device in the alternative embodiment 12.

FIGS. 21 and 22 illustrate an example in which a plurality of micro-channel sets 32 each having the plurality of the micro-channels 14 connected to each other are connected to one gas outlet 30. Also, a plurality of the micro-channel groups 31 each having the plurality of the micro-channel sets 32 are formed in the substrate 10.

As described above, forming a plurality of the openings 14*a* for one micro-channel 14 or connecting a plurality of the micro-channels 14 to one gas outlet 30 leads to an increase in the amount of gas being discharged from the one gas outlet 30, and thereby leading to an increase in the exhaust gas pressure. Further, discharging gas for a long period of time from one gas outlet 30 is also made possible.

Particularly, for example, arranging the openings 14*a* densely as illustrated in FIG. 19 allows production of a microfluidic device that is small and can discharge gas at a high output for a long period.

If the openings 14*a* are disposed densely as illustrated in FIG. 19, an LED array having a plurality of LEDs regularly arranged therein is preferable as the light source.

Further, the plurality of the openings 14*a* formed in a single or plurality of the micro-channels 14 connected to one gas outlet 30 may be irradiated with light at the same time or different times. Irradiating the plurality of the openings 14*a* with light at different times makes it possible to lengthen the period during which gas can be discharged.

The invention claimed is:

1. A microfluidic device has a gas generation portion, said gas generation portion comprising:

a substrate having a first main surface, a second main surface, and a micro-channel formed therein, said micro-channel having an opening on the first main surface; and a gas generation layer disposed on and co-extensive with the first main surface of the substrate so as to cover the opening and that generates gas by receiving an external stimulus.

2. The microfluidic device according to claim 1, wherein the gas generation layer is a gas generation film attached on the first main surface.

3. The microfluidic device according to claim 1, wherein the gas generation portion further comprises a barrier layer provided on the reverse side of the substrate side of the gas generation layer.

4. The microfluidic device according to claim 3, wherein the barrier layer is disposed so as to cover the gas generation layer and is joined to the substrate over the entire outer periphery of the gas generation layer.

5. The microfluidic device according to claim 3, wherein the gas generation layer has a continuous hole that is connected to the opening at one end thereof and is connected, at an other end thereof, to a surface on the reverse side of the substrate side of the gas generation layer.

6. The microfluidic device according to claim 3, wherein the barrier layer is a membrane or a plate made of glass or resin.

7. The microfluidic device according to claim 1, wherein the substrate has a plurality of the micro-channels, and the gas generation layer includes a gas generator generating gas upon being irradiated with light and further has a light shield layer that is provided, in a plane view, between the adjacent openings of the micro-channels so as to shield the gas generation layer from light.

8. The microfluidic device according to claim 1, wherein the gas generation layer is attached on the substrate, and the microfluidic device has a groove or hole which is connected to the opening, on at least one of the substrate-side surface of the gas generation layer and the first main surface of the substrate.

9. The microfluidic device according to claim 8, wherein the groove or the hole extends from the opening toward the surface of the substrate.

10. The microfluidic device according to claim 8, wherein the microfluidic device has a plurality of the grooves or the holes, and the plurality of the grooves or the holes each extend radially from the opening toward the surface of the substrate.

11. The microfluidic device according to claim 1, wherein at least one of the substrate-side surface of the gas generation layer and the first main surface of the substrate is a rough surface.

12. The microfluidic device according to claim 1, wherein the gas generation layer contains a gas generator that generates gas by receiving an external stimulus.

13. The microfluidic device according to claim 12, wherein the gas generator contains at least one of an azo compound and an azide compound.

14. The microfluidic device according to claim 12, wherein the gas generation layer further contains a binder resin.

15. The microfluidic device according to claim 14, wherein the binder resin further contains a pressure-sensitive adhesive resin.

16. The microfluidic device according to claim 1, wherein the micro-channel has a plurality of openings on the first main surface.

17. The microfluidic device according to claim 1, wherein the substrate has a plurality of the micro-channels that are connected to one another.

* * * * *